United States Patent [19]

Jahns et al.

[11] 4,187,039

[45] Feb. 5, 1980

[54] METHOD AND APPARATUS FOR CONSTRUCTING AND MAINTAINING AN OFFSHORE ICE ISLAND

[75] Inventors: Hans O. Jahns; Newton K. Maer, Jr., both of Houston, Tex.

[73] Assignee: Exxon Production Research Company, Houston, Tex.

[21] Appl. No.: 939,538

[22] Filed: Sep. 5, 1978

[51] Int. Cl.[2] ..... E02B 17/00; E02D 23/16

[52] U.S. Cl. ..... 405/217; 405/61; 405/130

[58] Field of Search ..... 405/11, 14, 61, 130, 405/217; 165/45; 62/259, 260

[56] References Cited

U.S. PATENT DOCUMENTS

| | | | |
|---|---|---|---|
| 907,441 | 12/1908 | Baur | 405/130 |
| 3,738,114 | 6/1973 | Bishop | 405/217 |
| 3,750,412 | 8/1973 | Fitch et al. | 405/217 |
| 3,798,912 | 3/1974 | Best et al. | 405/217 |
| 3,972,199 | 8/1976 | Hudson et al. | 405/217 |
| 3,990,253 | 11/1976 | Lea et al. | 405/217 |
| 4,055,052 | 10/1977 | Metge | 405/217 |
| 4,094,149 | 6/1978 | Thompson et al. | 405/130 |
| 4,118,941 | 10/1978 | Bruce et al. | 405/204 |

OTHER PUBLICATIONS

"Caisson Retained Drilling Islands", *Ocean Industry,* Jun. 1978, pp. 47–48.

"Passive Refrigeration for Artic Pile Supports", ASME Paper No. 75-PET-26, Jun. 19, 1975.

"Novel Approaches to Arctic Drilling", *Oilweek,* Nov. 3, 1969, p. 49.

*Primary Examiner*—David H. Corbin

*Attorney, Agent, or Firm*—Marc L. Delflache

[57] ABSTRACT

A method and apparatus is disclosed for forming and maintaining an offshore ice structure in an Arctic environment. The structure is formed by a series of caissons oriented in a ring forming an enclosure capable of retaining a predetermined amount of water and thereby defining an ice island when frozen. The structure includes a passive heat extracting system which removes heat from the water within the enclosure and from the soil immediately below the enclosure and the caissons thereby advancing the freezing of the soil beneath the enclosure and water within the enclosure. In this manner, the lateral stability of the structure is improved by providing a single frozen mass of water and soil bonded in unitary construction increasing the foundational base of the structure. In addition, refrigeration means are provided to prevent surface melting of the ice within the enclosure and preserve the integrity of the ice structure during warmer months. The island structure can, therefore, withstand greater lateral ice loads during the winter months and greater wave loads during the summer months and also provide a dry surface from which offshore operations can be conducted year-round.

22 Claims, 5 Drawing Figures

METHOD AND APPARATUS FOR CONSTRUCTING AND MAINTAINING AN OFFSHORE ICE ISLAND

BACKGROUND OF THE INVENTION

1. Field of the Invention

The present invention relates to a method and apparatus for forming an offshore structure and, more particularly, for forming an offshore ice structure in an Artic environment that can withstand large lateral loads and provide a working surface for offshore operations year-round.

2. Description of the Prior Art

With increased activity in the Arctic for petroleum exploration and production, the need arises for offshore structures which can provide a dry working surface year-round. The use of retaining structures offshore as artificial islands is well known. However, the art is primarily limited to a discussion of fill materials, such as sand, gravel, silt, slurry, or the like, as the principle support material circumscribed by the retaining walls of the structure. At times, however, these fill materials may not be readily available. This has necessitated, therefore, the development of alternate designs of offshore Arctic structures which do not use the traditional fill materials.

In addition to the problem associated with the availability of fill materials, lateral loading resulting from the movement of large ice floes has posed a major design problem for the present retaining structures. Traditionally, retaining structures are gravity founded, and are, therefore, vulnerable to lateral forces. To resist the large lateral loads exerted by the ice floes, and thereby prevent sliding of the structure along the sea bottom, gravity base structures are generally very large, i.e. several hundred feet in diameter and weighing several hundred thousand tons.

Recognizing these problems, industry has considered several approaches. One such approach calls for the separation of a large ice plate from a pre-existing ice formation. The ice plate is then grounded to provide an island from which offshore activities can be conducted. However, wave action in the summer months rapidly erodes the unprotected ice plate. Therefore, the plate must be sized to compensate for a pre-determined amount of melting and erosion by wave action during the summer so as to provide a design life of at least two winters. However, to survive the summer months, the ice plate would need to be very large initially, perhaps more than 1000 feet in diameter.

Therefore, there exists a need for a more practical retaining structure that can provide a year-round operating surface and can satisfy the environmental factors, lateral loading criteria and seasonal restraints.

SUMMARY OF THE INVENTION

Recognizing the problems associated with the prior art, the present invention is a method and apparatus for constructing an offshore ice island in the Arctic that uses ice as the primary support material. The present invention is capable of supporting offshore operations yearround and is able to withstand large lateral loads by freezing water within the structure and soil immediately beneath the freezing water in a unitary mass.

Briefly, the offshore structure comprises a series of caissons arranged in a ring configuration and supported on the ocean floor. The structure also includes a heat extracting means and a support means which supports the heat extracting means within the enclosure defined by the ring configuration. The heat extracting means removes heat not only from the water within the enclosure but also from the upper region of the soil immediately beneath the enclosure. In this manner, freezing of the water within the enclosure is accelerated. The heat extracting means also extends through the caissons several feet into the soil immediately beneath the caissons. As heat is extracted from the soil beneath the caissons and the enclosure, the soil and body of water within the enclosure simultaneously freeze providing a unitary mass of frozen material. This increases the lateral stability of the structure since the frozen soil provides additional resistance to horizontal forces acting against the structure.

In a modification of the invention, the structure also comprises a means for refrigerating the top surface of the ice island formed within the enclosure. The refrigeration means is particularly important in warm months to prevent surface melting of the island and ensure the integrity of the ice structure.

In a further modification, the structure includes a means for maintaining the ice adjacent the outer peripheral edge of the caissons in a weakened state to reduce the load imposed on the ice island by the surrounding ice formation.

In forming the offshore structure the caissons are transported to location, either previously arranged in the ring configuration or connected at sea following the transportation. The caissons are then submerged and set on the bottom of the body of water.

By installing a means for extracting heat from the body of water defined by the enclosure and from the soil beneath and below the caissons and the body of water within the enclosure, the formation of the ice structure is advanced passively by removing heat thereby permitting the subfreezing temperatures of the Arctic to accelerate the formation of the ice island.

By removing heat from the body of water within the enclosure with the heat extracting means to advance the freezing of the body of water within the enclosure and further removing heat from the soil below and beneath the caissons and the body of water within the enclosure, the formation of the ice structure is accelerated passively permitting the simultaneous freezing of the water within the enclosure and the soil immediately below and beneath the caissons and the enclosure in a unitary manner providing a larger foundational base.

It is an object of the present invention to provide an offshore structure in an Arctic environment formed primarily of ice and capable not only of resisting large lateral bonds but also capable of providing a dry working surface year-round for offshore activity.

BRIEF DESCRIPTION OF THE DRAWINGS

In order that the features of this invention may be better understood, a detailed description of the invention as illustrated in the attached drawings follows.

DETAILED DESCRIPTION

Figure 1:
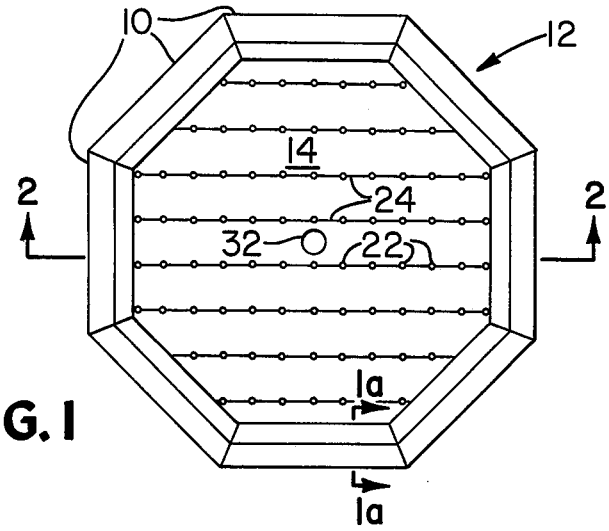
FIG. 1 is a plan view of a plurality of caissons arranged in a ring configuration.

Referring to the figures and, more particularly, referring to FIG. 1, a plurality of caissons 10 as seen from a plan view are arranged in a ring configuration forming a ring structure 12 and defining an enclosure 14. Typically, the ring geometry would comprise six to ten sides; however, for purpose of the present invention, the geometric shape formed by the interconnected caissons 10 is not important so long as an enclosure 14 is defined which is protected from the open sea in all directions. Obviously, the shape of the enclosure will be a limiting factor deserving of some consideration in determining the required surface area and possible additional restraints imposed by the installation and removal of the caissons. However, the shape of the enclosure 14 is not important to the spirit and scope of the present invention. The inside dimension of the ring structure 12, which is also the outside dimension of the ice island formed therein, is fixed for a particular ring structure; however, for offshore Arctic drilling and producing activities the dimension generally varies from 200–400 feet depending on the structure's intended use and exact location.

Figure 1A:
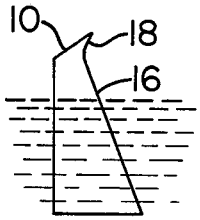
FIG. 1*a* is a cross-sectional view taken along line 1*a*—1*a* of FIG. 1 illustrating the cross-sectional geometry of a caisson.

Referring to FIG. 1*a*, the outside surface 16 of the caisson 10 is typically sloped to reduce the lateral or horizontal loading from ice formations striking the caissons. During open water periods, the sloped surface 16 also assits in reducing the wave loads. Primarily, however, the caissons prevent erosion of the ice island during open water periods. A deflection shield 18 is located at the top end of the caisson to prevent broken pieces of ice from riding up into the enclosure 14. The water depth is chosen such that the deflection shield 18 is above the water surface after installation.

Figure 2:
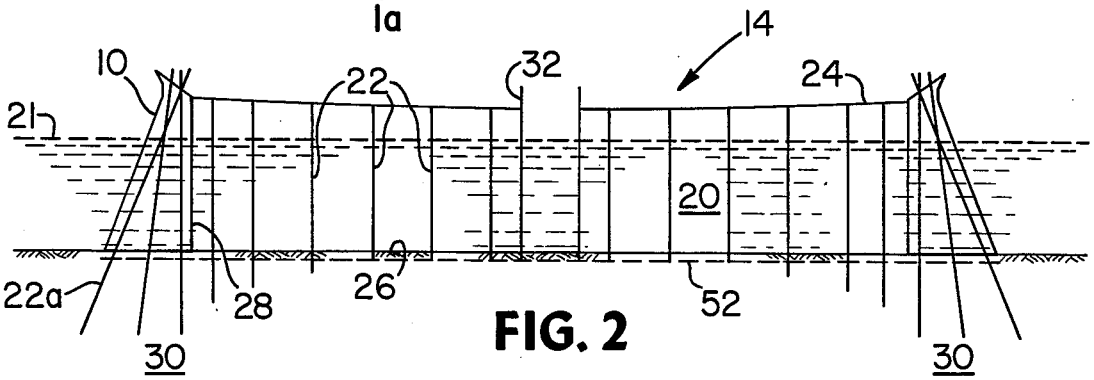
FIG. 2 is a local cross-sectional view taken along line 2—2 of FIG. 1 wherein the water within an enclosure defined by the caissons is unfrozen.

FIG. 2 is a local cross-sectional view taken along line 2—2 of FIG. 1. In this view, the water 20 within the enclosure 14 has not yet frozen. A plurality of heat pipes 22 are located within the enclosure 14. The heat pipes 22 are attached at their upper end to several suspension cables 24. Each cable 24 is connected at each end to the caissons 10. Typically, the suspension cables 24 are parallel to one another across the top of the enclosure 14 as illustrated in FIG. 1, thereby filling the enclosure with a predetermined pattern of heat pipes 22. Nearer the center of the enclosure 14 the heat pipes penetrate the sea bed 26 the least amount, e.g. approximately 2–4 feet. The penetration depths for the heat pipes increases radially to a maximum depth, e.g. 10–30 feet, at the outer edge of the enclosure 14 adjacent the inside wall 28 of the caissons 10. The variable depth of the heat pipes 22 forms a wedge-shaped frozen mass 23 (FIG. 4) which reinforces a frozen soil ring 25 (FIG. 4) immediately below the caissons 10. The wedge-shaped frozen mass 23 prevents the shearing of the frozen soil ring 25 as the seabed upon the application of horizontal forces thereby improving the lateral stability of the ice structure. The heat pipes near the center of the structure are set some nominal depth in the seabed to form the apex of the wedge-shaped mass. On the other hand, the heat pipes 22 near the outer edge of the enclosure 14 which forms the outer vertical dimension of the wedge-shaped mass are set at a depth substantially similar to the desired depth of the frozen soil ring 25. The heat pipes 22 from the center of the island to the outer edge of the enclosure may increase gradually in penetration depth to distribute the horizontal forces from the island into the wedged-shaped mass and subsequently into the soil ring 25 for dissemination into the soil. Actually, as discussed below, the wedge-shaped frozen mass 24 along with the frozen soil ring is formed simultaneously with the freezing of the water within the enclosure 14 resulting in a single unitary mass of frozen matter.

A plurality of outer peripheral heat pipes **22*a* are located within the caissons 10. The heat pipes 22*a* extend throughout the height of the caissons penetrating the soil immediately below and beneath the caisson to a predetermined depth. The heat pipes 22*a* form the frozen soil ring 25 below the caissons 10. The penetration depth of the heat pipes 22*a* will be a function of several variables such as soil condition, water depth, island dimensions and ice conditions. For example, the outer peripheral heat pipes of a structure approximately 300 feet in diameter located in 30 feet of water with a sandy-type soil would penetrate the soil approximately 20–40 feet. That portion of the heat pipes 22*a* below the water level 21 within the caissons 10** should be insulated to prevent absorption of heat from the water within the caissons. This prevents the formation of excessive ice within the caissons which could hamper the demobilization of the structure as discussed below.

The use of heat pipes to absorb heat from an embedding medium is well known. Typically, heat pipes are elongated, tubular members sealed at both ends and containing a refrigerant such as Freon. The heat pipes are similar to those designed to provide permafrost protection adjacent to Arctic pipelines and other Arctic foundations as described in a paper entitled "Passive Refrigeration For Arctic Pile Support" by J. W. Galate presented at the Petroleum Engineering Conference, Tulsa, Oklahoma, Sept. 21–25, 1975, see *Transactions of A.S.M.E., Journal of Engineering for Industry,* Vol. 98, Series 2, No. 2, pp. 695–700 (May, 1976). By passively removing heat from the surrounding medium, the heat pipes accelerate the freezing of the water within the enclosure 14 along with the soil 30 immediately below and beneath the enclosure 14 and the caisson 10 in a unitary mass. The specifics on the formation and the maintenance of the ice structure itself are discussed in greater detail below with respect to FIG. 3.

Referring still to FIG. 2, a silo 32 is installed preferably at the center of the enclosure 14. The silo 32 is an open elongated tubular member extending from above the water surface 21 to slightly below the sea bed 26. No heat pipes are installed in the silo. After formation of the island, the naturally frozen ice cover 33 (see FIG. 3) within the silo will be removed so that the silo 32 provides open communication from the top of the ice structure to the sea bed for a blowout preventer stack, conductor pipe or related petroleum drilling/producing equipment.

Figure 3:
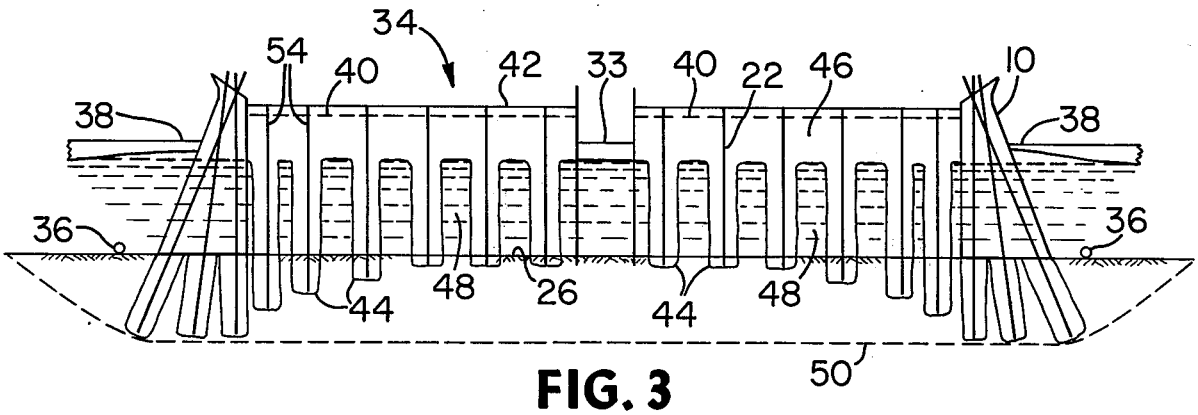
FIG. 3 is a local cross-sectional view taken along line 2—2 of FIG. 1 where the water within the enclosure is substantially frozen and a surcharge of ice has been formed by flooding.

Referring to FIG. 3, which is a local cross-sectional view taken along line 2—2 of FIG. 1, the initial formation of the ice structure is shown. While FIG. 2 illustrates a typical view of the caisson structure during the first summer months prior to the formation of the ice island, FIG. 3 shows an ice island 34 beginning to form within the enclosure 14 extending down into the soil immediately below and beneath the enclosure and the caissons.

In a modification of the invention, a heating cable 36 is installed on the sea bed 26 circumscribing the peripheral edge of the caissons. The heating cable 36 is an electrical resistance conductor which propagates heat to maintain a band of outer ice 38 immediately adjacent the caissons in a weakened state; i.e., thinner, thereby reducing the load imposed on the ice structure by the surrounding ice formation. When the ice pack begins to move, the band of thinner ice 38 is crushed. Due to the nature of ice, the initial crushing of the band of ice is followed by continuous crushing in combination with the deflection of the ice pack and subsequent breaking as the ice advances upward against sloped surface 16. Such is preferred since the horizontal force exerted by the ice pack due to the combination of crushing and bending of the ice pack against the structure is less than the horizontal force due to continuous crushing alone.

In a further modification of the invention, refrigeration mats 40 are located immediately below a working surface 42 of the ice structure. The mats 40, unlike the heat pipes, are an active refrigeration system and prevent surface melting of the ice structure during the warmer months. Being an active refrigeration system, the mats 40 require compressors and additional support equipment (not shown) to operate. Typically, the refrigeration equipment would be supported on the working surface 42.

With respect to the formation of the ice island, the caissons are first towed to location and submerged. The water depth is chosen such that the height of the caisson is at least equal to the water depth. After the caissons have been installed on the sea bed and all heat pipes properly located, the freezing operation commences. The heat extracting system is a passive system in the sense that the freezing arctic temperatures are responsible for the formation of the ice structure. Therefore, the ring structure 12 should preferably be installed in the fall months before the first hard freeze. As the winter months approach, freeze bulbs 44 (see FIG. 3) form around each heat pipe extending from the bottom of the heat pipe to the water surface.

Once a solid ice cover has formed at the water surface above the bulbs 44, controlled flooding of the enclosure above the water surface begins. Water is periodically pumped onto the frozen ice cover and permitted to freeze in layers, thereby forming a layer of ice 46 above the natural water-line commonly known as a surcharge. Flooding is accomplished by means of pumps (not shown) mounted within the caissons 10 which draw seawater from outside the ring structure 12. The ice buildup or surcharge would be monitored and controlled to offset the buoyancy of the freeze bulbs 44 without unduly overloading them. In this manner, a work surface is eventually formed a predetermined elevation above the natural water-line. Preferably, a 10-foot surcharge would be formed providing a dry working surface sufficiently elevated to avoid interference in the work schedule due to tidal fluctuations. The surcharge also provides additional lateral resistance to sliding of the ice island due to the increased weight of the island overall. The same pumps which flood the enclosure above the top of the freeze bulbs 44 could be used to remove brine-rich water from within a series of gaps 48 between the bulbs 44. This will assure the proper merging of the bulbs below the water surface as the freezing process continues.

Without the use of heat pipes to increase the lateral stability of the island, the structure would tend to slide along the seabed whenever sufficient lateral force was exerted. In other words, the structure would move along a plane 52 which is substantially coplanar with the seabed. However, with the use of heat pipes, the structure will not move coplanar to the seabed along plane 52. Rather, once the bulbs 44 merge forming a unitary frozen mass, the structure, instead of moving or "failing" along plane 52, will fail along a plane 50 which is substantially parallel to the seabed and tangent to the bottom of the freeze bulbs 44. The lateral force required to move the structure along the plane 50 is substantially more than the force required to move the structure along plane 52. Generally, this is spoken of in terms of the lateral load required to generate a particular mode of failure, i.e. shear failure of the soil along plane 50 as compared to shear failure of the soil along plane 52. Therefore, due to the unitary formation of the ice island, the lateral stability of the structure is improved by requiring a shear failure along plane 50 which is more difficult to cause due to the increased surface area, larger overburden, and higher soil strength at plane 50 as compared with plane 52 where, traditionally, the shear failure mode would have occurred.

The refrigeration mats 40 would be installed several inches below the working surface 42 of the ice island. During the formation of the surcharge 46, the mats would be installed prior to final freezing of the last 6–12 inches, for example.

Normally, heat pipes discharge the absorbed heat from the surrounding medium at their top end 54. However, to provide a smooth working surface 42 the lengths of the heat pipes should be selected such that the surface 42 barely covers the top end 54 of each pipe. This is possible since the refrigeration mats 40 would permit continued removal of heat from the heat pipes after they are no longer exposed to the cold air. In this manner, the heat pipes function year-round removing heat from the water within the enclosure 14 and the soil immediately below the enclosure 14 and the caisson 10 ensuring that the ice island remains in a frozen state. Another purpose of the refrigeration mats 40 is to maintain the working surface 42 in a frozen state during the warm months thereby preventing surface melting.

Figure 4:
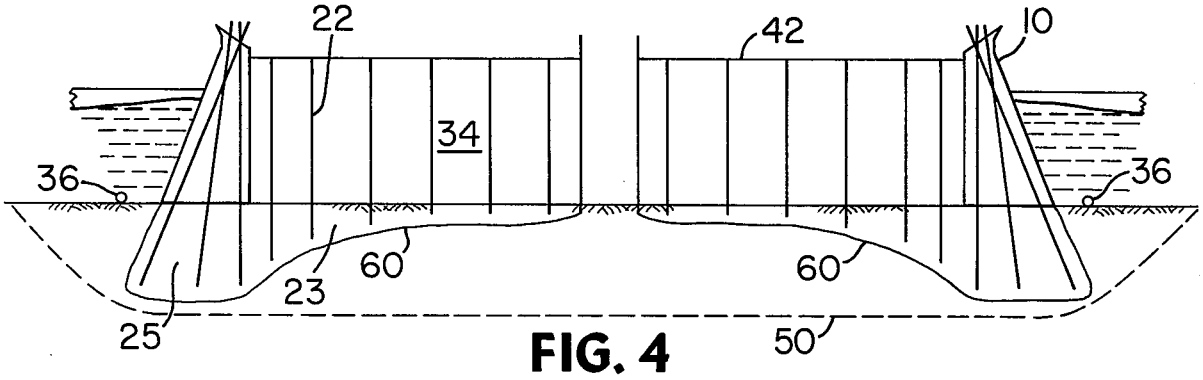
FIG. 4 is a local cross-sectional view taken along line 2—2 of FIG. 1 wherein the entire body of water within the enclosure is frozen to the soil immediately below the caissons and the enclosure.

Referring to FIG. 4, the ice island structure is shown in its final form. A unitary mass 60 of frozen water and soil is formed following the merger of all freeze bulbs. The additional resistance to lateral loading offered by the present invention is evident in view of this disclosure when comparing the location of lateral failure in prior art retaining structures (plane 52—see FIG. 2) with the location of lateral failure along the modified shear failure plane 50 of the present invention.

The bulk of the foundational strength within the unitary frozen mass is provided by the frozen soil beneath the caissons. The soil beneath the enclosure is frozen in a variable depth manner due to the varying penetration of the heat pipes 22 as discussed above. This variation in the penetration depths of the heat pipes reinforces the frozen soil ring 25. This prevents the localized failure of the frozen soil ring below the caissons upon the application of lateral loads. By reinforcing the frozen soil ring 25 with a wedged-shaped mass 23 as discussed above, the failure mode for the structure is altered resulting in a stronger integrated structural mass.

For illustration purposes, a 300-foot diameter ice structure having a 10 foot surcharge, peripherral heat pipes 22a embedded 20 feet into the seabed, a submerged soil weight of 60 lbs./ft$^3$, an ice surcharge density of 56 lbs./ft$^3$, and a coefficient of friction along plane 50 between the frozen mass and soil of 0.6, the present invention can resist approximately 75,000 kips of lateral load. By comparison, a similar ice island structure without heat pipes could only resist approximately 24,000 kips.

To demobilize the structure, the active refrigeration system (not shown) which maintains the refrigeration mats is shut in. This permits the gradual surface erosion of the ice structure. The refrigeration mats are removed from the ice surcharge when the surface has melted a predetermined amount exposing the mats. Warm water is circulated within the caissons loosening the ring structure from the ice island itself. The heat pipes are removed by injecting steam near each pipe. Alternatively, the heat pipes may be steamed out by means of series of tubes (not shown) attached to the outer surface of each pipe prior to installation. The ring structure is finally removed by deballasting the caissons and disconnecting the ring structure at least at one point, permitting the caisson to ascend to a neutral, free-floating position thereby abandoning the ice mass which formed the island. The caissons can then be towed to another location for subsequent use.

If the first freeze-up occurs around October 1 and average Alaskan North Slope weather is experienced, the island could be ready for offshore petroleum related activity by January. The present invention requires a minimum amount of support equipment to initiate the formation of the ice island since the primary heat extracting means is passive. While the present invention relies upon the freezing temperatures of the Arctic to initiate the freezing process, the formation of the island is accelerated by the use of heat pipes. In addition, the lateral stability of the structure is substantially enhanced by the unitary freezing of the water within the enclosure along with the seabed immediately beneath the enclosure.

It will be apparent to those skilled in the art that modifications and changes in both the apparatus and the method described herein may be made without departing from the spirit and scope of the invention. Therefore, it is applicants' intent in the following claims to cover all such equivalent modifications and variations as fall within the scope of the invention.

What we claim is:

1. An apparatus for constructing an offshore ice island in an Arctic environment comprising:

a plurality of caissons, having a top and bottom, adapted to be submerged to the bottom of a body of water and arranged in a ring configuration defining an enclosure for maintaining a body of water therein, and means for passively extracting heat from the water within said enclosure and soil below said caissons wherein said passive heat extracting means is located within said enclosure extending substantially to the soil below said enclosure and said passive heat extracting means is located within said caissons extending from the top of said caissons through the bottom of said caissons and into the soil below said caissons such that said passive heat extracting means accelerates the freezing of the water within the enclosure and the soil below said caissons in a unitary manner forming a mass of frozen material having a frozen soil ring below said island which improves the lateral stability of said island.

2. The apparatus according to claim 1 wherein said apparatus further includes means for supporting said heat extracting means within said enclosure.

3. The apparatus according to claim 2 wherein said heat extracting means comprises a plurality of enclosed elongated members having a refrigerant material enclosed therein, said heat extracting means is supported over said enclosure by said support means such that one end of each elongated member contacts the bottom of said body of water.

4. The apparatus according to claim 3 wherein said support means comprises a plurality of cables attached to said caisson and having one end of each of said elongated member attached to one of said plurality of cables.

5. The apparatus according to claim 1 wherein said apparatus further includes means for refrigerating the top surface of the ice within said enclosure to prevent surface melting during the warmer months and to maintain the ice island in a frozen state.

6. The apparatus according to claims 2 or 5 wherein said apparatus further includes an open tubular member supported on the bottom of the body of water and passing through said enclosure to provide an open chamber from the surface of the water to the bottom of the body of water.

7. The apparatus according to claim 6 wherein said apparatus further includes means for maintaining the ice outside the peripheral edge of said caissons in a weakened state to reduce the load imposed on the ice island by the surrounding ice formation.

8. The apparatus according to claim 7 wherein said means for maintaining the ice in a weakened state comprises an electrical resistance heating cable circumscribing the outer peripheral edge of said caissons.

9. The apparatus according to claim 1 wherein said passive heat extracting means within said enclosure penetrates the bottom of the body of water such that the penetration of said heat extracting means increases radially with respect to the center of said enclosure forming a wedge-shaped mass attached to said frozen soil ring further improving the lateral stability of said island.

10. A method for forming an offshore ice structure in an Arctic environment comprising the steps of:

(a) submerging a plurality of caissons arranged in a ring configuration defining an enclosure to the bottom of a body of water such that the height of said caissons is at least equal to the depth of said body of water;

(b) installing a means for passively extracting heat from the body of water within said enclosure and from the soil beneath and below said caissons and said body of water within said enclosure;

(c) passively removing heat from the body of water within said enclosure by said passive heat extracting means to advance the freezing of the body of water within said enclosure forming said ice structure; and (d) further passively removing heat from the soil below and beneath said caissons and said enclosure to advance the freezing of said soil with the water within said enclosure in a unitary manner forming a mass of frozen material having a frozen soil ring below said ice structure enlarging the foundational base of said ice structure and improving the lateral stability of said ice structure.

11. The method according to claim 10 wherein said method further includes the step of flooding in layers the enclosure above the frozen body of water within said enclosure permitting each layer to freeze thus elevating the top surface of said ice structure to a predetermined elevation above the natural water-line.

12. The method according to claim 1 wherein said method further includes the step of installing refrigeration means near the surface of the body of water within said enclosure during the freezing of said body of water to prevent the surface melting of said ice during the warmer months and to maintain the ice structure in a frozen state.

13. The method according to claim 12 wherein said method further includes the step of installing a heating cable around the peripheral edge of said caissons to maintain the outer ice layer adjacent said caissons in a weakened state to reduce the load imposed on the structure by the surrounding ice formation.

14. The method according to claim 10 wherein said method further includes the step of installing an elongated tubular member through the body of water within said enclosure extending from the surface of the body of water to the sea bottom to provide access for drilling and operating equipment associated with petroleum production.

15. The method according to claim 13 wherein said offshore structure is demobilized and said caissons are removed by said method further including the steps of:

circulating warm water within said caissons to free said caissons from the ice structure formed within said enclosure;

removing said heat extracting means by injecting steam adjacent said means; and deballasting said caissons and disconnecting said caissons at least at one point to permit their ascension to the water surface.

16. An apparatus for constructing an offshore ice island in an Arctic environment comprising:

a plurality of caissons, having a top and bottom, adapted to be submerged to the bottom of a body of water and arranged in a ring configuration defining an enclosure for maintaining a body of water therein, and means for passively extracting heat from the water within said enclosure and the soil below said island wherein said passive heat extracting means is located within said enclosure extending into the soil below said enclosure and said passive heat extracting means is located within said caissons extending into the soil below said caissons such that said passive heat extracting means accelerates the freezing of the water within said enclosure and the soil below said caissons and enclosure in a unitary manner forming one mass of frozen material having a frozen soil ring below said island which improves the lateral stability of said island.

17. The apparatus according to claim 16 wherein said passive heat extracting means comprises a plurality of enclosed elongated members having a refrigerant material enclosed therein.

18. The apparatus according to claim 16 wherein said apparatus further includes means for supporting said passive heat extracting means within said enclosure.

19. An apparatus for constructing an offshore ice island in an Arctic environment comprising:

a plurality of caissons, having a top and bottom, adapted to be submerged to the bottom of a body of water and arranged in a ring configuration defining an enclosure for maintaining a body of water therein, and a plurality of heat pipes supported within said enclosure and extending from the top of said enclosure into the bottom of the body of water below said enclosure and supported within said caissons extending from the top of said caissons through the bottom of said caissons and into the soil below said caissons wherein said heat pipes are adapted to passively remove heat from the body of water within said enclosure and the soil below said caissons and enclosure accelerating the freezing of the water and soil in a unitary manner forming a mass of frozen material having a frozen soil ring below said island which improves the lateral stability of said island by providing a larger foundational base.

20. A method for forming an offshore ice structure in an Arctic environment comprising the steps of:

(a) submerging a plurality of caissons, arranged in a ring configuration defining an enclosure, to the bottom of a body of water such that the height of said caissons is at least equal to the depth of said body of water;

(b) installing a means for passively extracting heat from the body of water within said enclosure and the soil beneath and below said caissons;

(c) passively removing heat from the body of water within said enclosure by said heat extracting means to advance the freezing of the body of water within said enclosure forming said ice structure; and (d) further passively removing heat from the soil below and beneath said caissons to advance the freezing of said soil with the water within said enclosure in a unitary manner forming a mass of frozen material having a frozen soil ring below said ice structure enlarging the foundational base of said ice structure and improving the lateral stability of said ice structure.

21. A method for forming an offshore ice structure in an Arctic environment comprising the steps of:

(a) submerging a plurality of caissons arranged in a ring configuration defining an enclosure to the bottom of a body of water such that the height of said caissons is at least equal to the depth of said body of water;

(b) installing a plurality of heat pipes supported within said enclosure and caissons wherein said heat pipes within said enclosure extend from the top of said enclosure and to the bottom of the body of water below said enclosure and said heat pipes within said caissons extends from the top of said caissons through the bottom of said caissons and into the soil below said caissons wherein said heat pipes are adapted to accelerate the freezing of water within the enclosure and the soil below said enclosure and caissons;

(c) passively removing heat from the body of water within said enclosure by means of said heat pipes accelerating the freezing of the body of water within said enclosure; and (d) further passively removing heat from the soil below said caissons and said enclosure by means of said heat pipes accelerating the freezing of the soil with the water within said enclosure in a unitary manner forming a mass of frozen material having a frozen soil ring below said ice structure enlarging the foundational base of said ice structure and improving the lateral stability of said ice structure.

22. The method according to claim 21 wherein the penetration of each of said heat pipes into the bottom of the body of water below said enclosure increases radially with respect to the center of said enclosure forming a wedge-shaped mass attached to said frozen soil ring further improving the lateral stability of said island.

* * * * *

UNITED STATES PATENT AND TRADEMARK OFFICE

CERTIFICATE OF CORRECTION

PATENT NO. : 4,187,039

DATED : February 5, 1980

INVENTOR(S) : Hans O. Jahns and Newton K. Maer, Jr.

It is certified that error appears in the above—identified patent and that said Letters Patent is hereby corrected as shown below:

Claim 12, column 9, line 9, delete "1" and insert therefor --11--.

Signed and Sealed this

*Twentieth* Day of *May 1980*

[SEAL]

*Attest:*

SIDNEY A. DIAMOND

*Attesting Officer*

*Commissioner of Patents and Trademarks*